US006119741A

United States Patent [19]

Rowe et al.

[11] Patent Number: 6,119,741

[45] Date of Patent: Sep. 19, 2000

[54] ROTARY CUTTER HEAD

[76] Inventors: David G. Rowe, 12901 Cedar St., Leawood, Kans. 66209; Mark Vernon Owens, 114 E. 147th St., Kansas City, Mo. 64145

[21] Appl. No.: 09/248,075

[22] Filed: Feb. 10, 1999

[51] Int. Cl.[7] ..... B27C 5/00

[52] U.S. Cl. ..... 144/230; 144/134.1; 144/117.1; 144/218; 144/229; 144/230; 144/241; 407/31; 407/37; 407/49

[58] Field of Search ..... 144/114.1, 117.1, 144/134.1, 135.2, 137, 218, 229, 230, 241; 407/37, 38, 41, 44, 47, 49, 51, 102, 108; 241/292.1, 294

[56] References Cited

U.S. PATENT DOCUMENTS

| | | | |
|---|---|---|---|
| 1,011,107 | 12/1911 | Blood . | |
| 1,344,411 | 6/1920 | Larson . | |
| 1,549,036 | 8/1925 | Westgard . | |
| 1,733,657 | 10/1929 | Ericson . | |
| 2,557,404 | 6/1951 | Armitage et al. . | |
| 3,228,438 | 1/1966 | Serry | 144/218 |
| 3,268,178 | 8/1966 | Schoeppner | 144/218 |
| 3,509,612 | 5/1970 | Lankin . | |
| 3,740,808 | 6/1973 | Shioya | 407/49 |
| 3,788,625 | 1/1974 | Lindsay . | |
| 3,882,912 | 5/1975 | Sybertz . | |
| 3,946,474 | 3/1976 | Hahn et al. . | |
| 4,031,934 | 6/1977 | Stadler | 144/135.2 |
| 4,193,719 | 3/1980 | Oaks . | |
| 4,211,507 | 7/1980 | Kress et al. | 407/37 |
| 4,257,462 | 3/1981 | Oller | 144/218 |
| 4,303,113 | 12/1981 | Andersson . | |
| 4,449,556 | 5/1984 | Colton . | |
| 4,819,703 | 4/1989 | Rice et al. | 144/230 |
| 4,922,977 | 5/1990 | Colton et al. . | |
| 5,005,619 | 4/1991 | Jensen . | |
| 5,176,191 | 1/1993 | Owens . | |
| 5,240,192 | 8/1993 | Tilby et al. | 144/230 |
| 5,658,101 | 8/1997 | Hammer . | |

*Primary Examiner*—W. Donald Bray
*Attorney, Agent, or Firm*—Spencer Fane Britt & Browne LLP

[57] ABSTRACT

A rotary cutter head is provided having body shape characterized, generally, outwardly-shifted cylinder segments to shift cutter head weight and force to the knife blades and to balance and extend the knifes from the central core of the cutter head while reducing workpiece waste buildup along the knife front, and while decreasing clogging of knife mounting components and reducing over-heating of knives and with securing corrugations on the knife cutting face, engageable with corrugations on the cutter head for securing the knife base against a foot on the cutter head.

16 Claims, 2 Drawing Sheets

ROTARY CUTTER HEAD

BACKGROUND OF THE INVENTION

The present invention relates generally to the field of rotary cutter heads used for woodworking machinery and in particular, to a novel rotary cutter head shape and knife anchorage system which shifts the mass of the cutter head to a more useful location at the base of the knife blades while removing cutter head mass from forward of the cutting surface of the knife blade and which provides reproducible height registration of the knife within the cutter head.

Typical of the majority of cutting heads is the use of two or more knife blades in a cutter head to distribute the cutting activity fully around the rotating cutter head. This reliance on anywhere from two to twelve knife blades is intended to reduce the strain on each individual knife while also reducing the amount of bite each blade must take from the wood and thereby providing a smoother cut on the wood and to even out the operation of the cutting head by distributing the points of impact against the workpiece fully around the diameter of the cutter head.

One drawback of this type of cutter head construction is that as the number of blades in a cutter head increases, the amount of area available to support each blade is reduced and the space for the mechanism used to secure the blade is reduced commensurately. This results in each blade being less securely locked into the cutter head and increases the possibility that a blade will loosen during use. A loose blade can ruin the workpiece and cause increased down time while the head is shut down, the loose blade retightened and its height readjusted to be uniform to the other blades installed in the cutter head. It will be appreciated by those skilled in the art that as the number of blades increases, so does the opportunity for any one blade to become loose or improperly aligned, therefore, either destroying the workpiece or causing additional downtime while adjustments are made to the cutter head. For many years blades have been held in cutter heads using combinations of set screws, knife receiving recesses in the cutter block, wedge means and spring pressure means to secure the knife blades in the cutter head, and to resist centrifugal force on the knife blade which tends to force the blades away from the cutter head. Depending on the configuration of these devices it is frequently necessary to shift the cutter head to several different positions in order to release or secure a knife with respect to the cutter head. In other cutter head configurations, it may be required to have access to the side of the cutter head to remove or install a knife. This shifting of the cutter head or side access requirement can make knife removal or installation a difficult and time consuming procedure and permit the position of the knife to change during installation procedures. This leads to knives which are not at equal height which causes a wavy cut on the work piece which is unacceptable.

It will further be appreciated by those skilled in the art that as the number of knife blades on a cutter head increases, so does the time increase which must be devoted to adjustment of the cutter head blades. It must be ensured that the blades are reasonably uniform in terms of their knife-edge profile, their mass, and their length so that the blades do not unbalance the cutter head once installed and prevent useful operation of the cutter head. An examination of the prior art reveals that a variety of adjustment means have been utilized to allow the individual knife blades to strike the workpiece at a uniform height above the center of the cutter head. As previously noted, if the blades are not uniform in height, a wave or ripple effect is caused in the workpiece, leaving the workpiece unusable or, alternatively, increasing the amount of finish time which must be devoted to the workpiece to make it suitable for use. However, generally these knife adjustment means incorporated into prior art devices allow minor changes in knife-height to be made by an operator installing a knife. These same adjustment means also permit the knives to be mis-adjusted and differently adjusted. This ability to adjust knife position, while helpful on the one hand, can be the source of problems on the other hand since the knife can be mis-adjusted as well as correctly adjusted.

Therefore, as the number of knife blades increases on any cutter head, the amount of time and effort and care which must be devoted to ensuring that each additionally installed knife blade is the equal to the previously installed knife blades increases, and the opportunity for failure for any one knife blade commensurately increases.

Various solutions to these problems have been attempted in the prior art, but none with complete satisfaction. The present invention provides a solution to these problems by providing a cutter head which allows knife insertion and removal while the cutter head is held in a single position. In this single position the knife securing means can be released and tightened while the knife is held in its proper position. In addition, the inventive cutter head and knife combination provides positive knife height registration of the knife with respect to the cutter head while avoiding the previous causes of any knife-shifting movements during tightening procedures. The present invention also permits sets of knives to be made which are of identical height, length, weight and shape which then can be inserted into the cutter head with reproducible and identical positioning of each knife. This attribute of the invention permits simplified cutter head balancing and dependable and reproducible knife height positioning of the set of knives in the cutter head. This accurate knife height positioning avoids a wavy cut in the workpiece which occurs when the knives in a cutter head are at different heights and therefore producing a different depth of cut in the workpiece.

SUMMARY OF THE INVENTION

Therefore, it is an object of the present invention to provide a rotary cutter head which displaces cutter head mass to a position at the base and behind each cutter knife while removing cutter head mass from forward of the knife blade in order to more securely install each knife blade against the cutter head and to remove cutter head area from in front of the knife blade to allow more efficient elimination of workpiece waste from the cutter head and cutting surface area.

Another object of the present invention is to allow convenient development of matched sets of knife blades which can be installed into the cutter head without any individual maintenance on any particular knife blade in order to achieve its proper conformation with respect to the other knives of the set. This is accomplished by the use of corrugations on the cutter head and the knife face which are spaced, uniformly, from the knife base and the cutter head knife foot. The knife and cutter head corrugations mate with each other upon installation of the knife in the cutter head with correct registration or mating of the corrugations assisted by a cutter head knife foot. The gib is then installed to compress the knife corrugations against the cutter head corrugations to secure the knife within the cutter head without any change in knife position.

Yet another object of the present invention is to provide a knife installation configuration into a cutter head which permits the cutter head to be placed in a single position with respect to the operator and to allow the knife securing means to be released or secured and the knife blade removed without any rotation of the cutter head during the installation or removal operation.

The foregoing and other objects are not meant in a limiting sense, and will be readily evident upon a study of the following specification and accompanying drawings comprising a part thereof. Other objects and advantages of this invention will become apparent from the following description taken in connection with the accompanying drawings, wherein is set forth by way of illustration and example, an embodiment of this invention.

DESCRIPTION OF THE DRAWINGS

A preferred embodiment of the invention, illustrative of the best mode in which the applicant has contemplated applying the principles, are set forth in the following description and are shown in the drawings and are particularly and distinctly pointed out and set forth in the appended claims.

DESCRIPTION OF A PREFERRED EMBODIMENT

Figure 4:
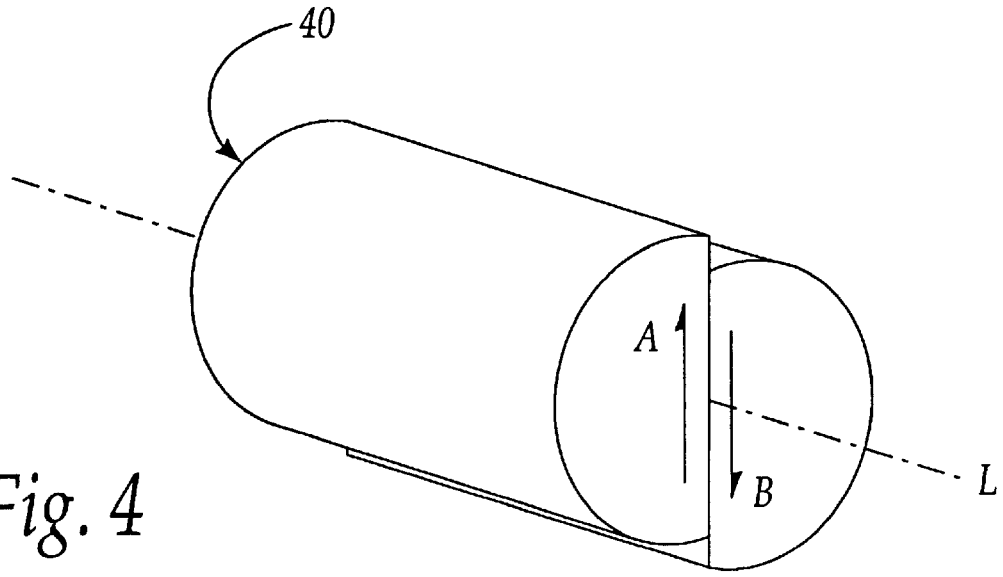
FIG. 4 is a rear and right side perspective view of a cylinder which has been divided in half and the halves shifted outwardly to provide a shape, generally, of outwardly-shifted cylinder segments or in the case of a bisected cylinder the shape of bi-laterally offset, cylinder halves.

Attention is first directed to FIG. 4 wherein the general geometric configuration from which of a preferred embodiment of the cutter head shape is derived is described. FIG. 4 shows a cylinder 40 which has been cleaved in half and which is referred to and defined herein as being bilaterally divided, with respect to longitudinal axis L. The cylinder is thus divided into cylinder half A and cylinder half B. Cylinder halves A and B are then shifted in opposite directions. Cylinder half A is shifted upwardly in the direction of Arrow A, and cylinder half B is shifted downwardly in the direction of Arrow B. This outward-shifting of the cylinder segments or bi-lateral off-set or outward displacement of the cylinder halves derives the general configuration shown in FIG. 4 and which is defined herein as being, generally, outwardly-shifted cylinder segments. In the case of a bisected cylinder the configuration is identified as bi-laterally offset, cylinder halves. This outward shifting of the segments (FIG. 4 and FIG. 5) places the cylinder segments slightly away from the center axis L (FIG. 4) or T (FIG. 5) of a cylinder thereby resulting in what is herein defined as outwardly-shifted cylinder segments.

Figure 1:
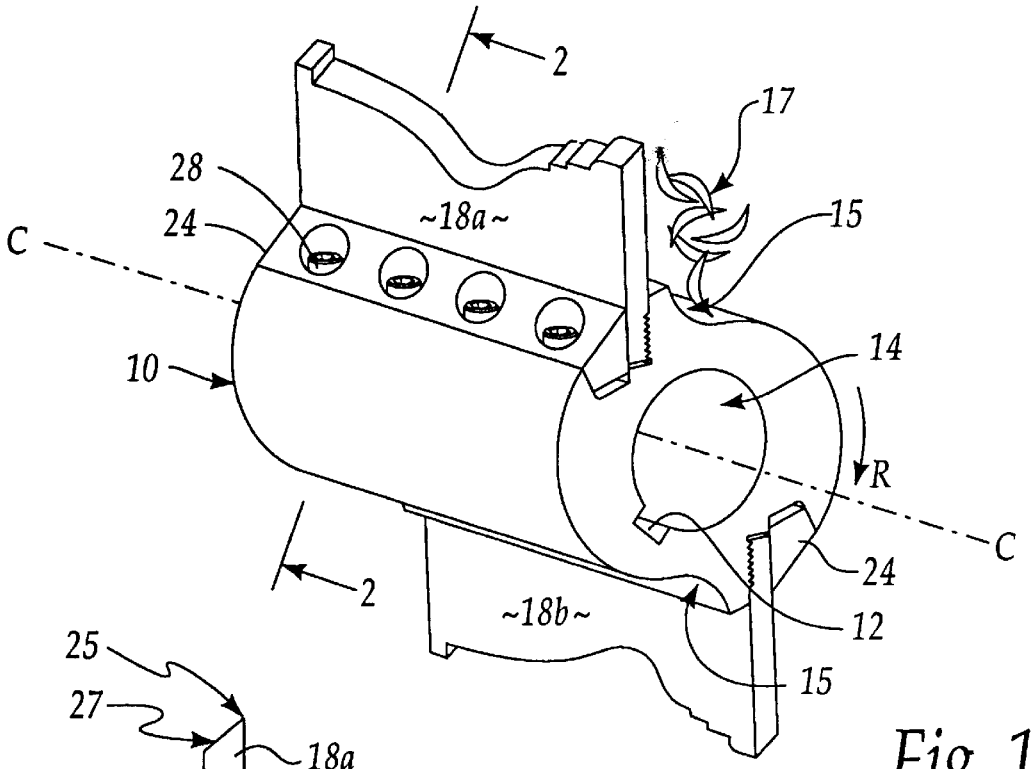
FIG. 1 is a rear and right side perspective view of the rotary cutter head shown apart from the spindle and with two knife blade inserted into the cutter head.
Figure 5:
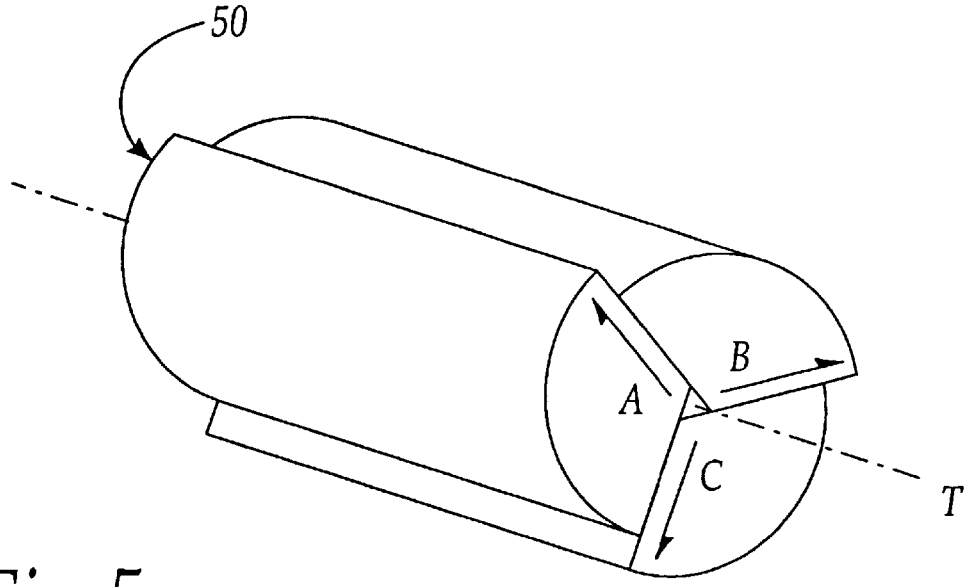
FIG. 5 is a rear and right side perspective view of a cylinder which has been divided in thirds and the three segments shifted outwardly to provide a shape, generally, of outwardly-shifted cylinder segments.

It is this configuration then which forms the basis of the configuration of the inventive cutter head taught herein and which configuration can be seen to be the basis of the shape of the cutter head body shown in FIG. 1. Similarly, as shown in FIG. 5, in the case of three knives being used in the head, it is possible to divided cylinder 50 in equal thirds A, B and C and to shift the mass of these three cylinder segments outwardly to space the segments outwardly from central axis T. In this fashion the novel features of the present invention can be applied to a configuration for three knives and expanded by this principle for additional knives.

It will be appreciated, of course, that the cutter head shown in FIG. 1 is not actually produced in the manner above described. Rather, the above description is provided in order to show how the mass of a cylinder is shifted outwardly of central axis C (FIG. 1) or L (FIG. 4) or T (FIG. 5) to provide additional mass behind the knife blade inserted into the cutter head. This shifting of the cylinder half geometry also reduces the mass in front of the cutter head to provide greater clearance in front of the cutter blade where waste materials are extruded while avoiding extending the cutter blade length so far as to create a danger.

Referring now to FIG. 1, a rear and right side perspective view of inventive cutter head 10 is shown having knife blade 18*a*, 18*b* installed therein for operation. In FIG. 1 the motivating power spindle has been removed for clarity. The power spindle would insert into cutter head 10 along a central longitudinal axis line C and would make secure rotatable contact with cutter head 10 by insertion of a portion of the spindle into spindle keyway 12 which is notched into cutter head 10 along a diameter of spindle insertion void 14. Once a spindle (not shown) is inserted into spindle void 14, in a manner to engage with spindle keyway 12, secure and stable rotation of cutter head 10 on the spindle can be maintained.

The geometry previously discussed with respect to FIG. 4 can be observed to be generally present in the cutter head 10 of FIG. 1. Cutter head 10 presents a shape in which the mass of cutter head 10 has been shifted outwardly and away from central axis C. The mass, therefore, is not closely distributed around a central longitudinal axis as one would find in a cylinder. The mass of cutter head 10 has been shifted or moved, generally, outwardly with respect to longitudinal axis C. This shifting of the mass increases the mass of cutter head behind each knife blade when cutter head 10 is rotating in the direction of Arrow R. In addition, this novel shaping of cutter head 10 reduces the mass of cutter head 10 which is on the leading edge or knife face 26 (FIG. 2) of knife 18*a*, 18*b*.

The shifting of cutter head mass through the use of the novel cutter head 10 shape achieves several beneficial results in a cutter head. The shifting of mass to the trailing side, behind and below knife back 29 (FIG. 2) of knife of 18*a*, 18*b*, allows the force generated by that mass to be contributed to the striking force or cutting power of knife 18*a*, 18*b*. The shifting of mass to the trailing side of knife 18*a*, 18*b* also provides additional cutter head area at the base of knife 18*a*, 18*b*, and allows use of a more substantial and stable securing means for knife 18*a*, 18*b* within cutter head 10.

Further, this shifting of mass reduces the amount of mass of cutter head 10 which is in front of knife face 26 (FIG. 2) of knife 18*a*, 18*b* creating leading edge depression 15 (FIG. 1) in front of each knife 18*a*, 18*b*. This reduction in leading edge mass results in substantially more open area in front of knife 18*a*, 18*b* and substantially less obstruction to the clearance of waste materials from the workpiece. Workpiece waste 17 (FIG. 1) is forced down in front of knife 18*a*, 18*b* and into leading edge depression 15 as cutter head 10 rotates in the direction of Arrow R. The greater area provided by leading edge depression 15 in cutter head 10 allows for rapid elimination of workpiece waste 17 which permits a cutter head to operate more efficiently and cleanly.

This reduction of workpiece waste 17 build-up also can reduce heat buildup in knife 18*a*, 18*b*. The packing of workpiece waste around knife 18*a*, 18*b* serves to insulate the knives during operation and increase the operating temperature of the knives by preventing air cooling of the knives. Inventive cutter head 10 reduces the build up of workpiece waste from around the knife 18*a*, 18*b* and reduces the resulting insulation of the knives and obstruction of desired heat loss from the knives.

Others working in this art have attempted to utilize a pocket or an indent on the leading edge of a knife blade in order to provide additional space for workpiece waste to be cleared from the cutting edge of the knife surface. However, generally these past attempts have either provided insufficient area for material clearance or have presented a pocket at the leading edge of the knife blade which then fills with waste material and becomes useless for its intended purpose. An example of the former may be seen in U.S. Pat. No. 4,303,113 (Andersson) in which pocket 15 is provided. However, pocket 15 is far too small to be useful in this manner. Examples of the latter debility may be seen in U.S. Pat. No. 1,011,107 (Blood), U.S. Pat. No. 3,882,912 (Sybertz), U.S. Pat. No. 4,193,719 (Oaks), and U.S. Pat. No. 4,922,977 (Colton) wherein depressions or pockets are provided on the leading edge of the knife blade in order to offer more area for deposit of waste from the workpiece. However, as each of these depressions or pockets has, itself, a leading edge wall spaced forwardly of the knife blade, these pockets tend to trap waste from the workpiece, especially waste from resinous woods. Such pockets during use tend to fill up with workpiece waste and become useless for their intended purpose.

In the inventive cutter head 10 described herein, no such leading edge wall is presented and workpiece waste 17 cannot build up adjacent to the cutter head. Therefore, the reduced mass at the leading edge of knife 18*a*, 18*b* of cutter head 10 to produce leading edge depression 15 acts to continually provide an unobstructed open area permitting removal of the cutting waste from the workpiece cutter head 10.

Figure 2:
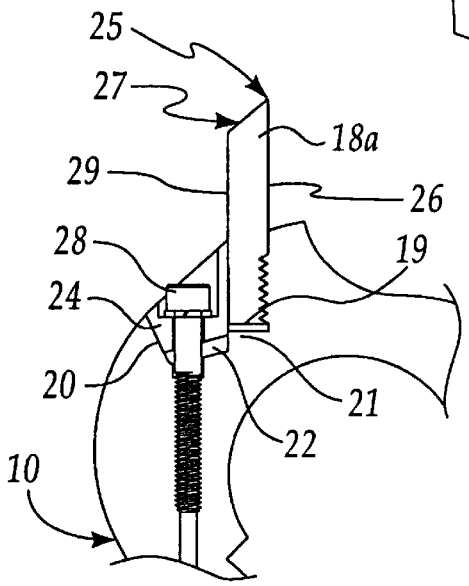
FIG. 2 is a fragmentary cross sectional view of the rotary cutter head shown in FIG. 1 taken along line 2—2 of FIG. 1, and showing the capture of the knife blade by the cutter head and the gib.

Referring now to FIG. 2, the securing of knife 18*a*, 18*b* within cutter head 10 will be described. FIG. 2 is a fragmentary view of a cross section taken along line 2—2 of FIG. 1. In FIG. 2 it may be seen that a void, or groove, 22 is in cutter head 10. Knife 18*a*, 18*b* fits within groove 22 and the base 19 of knife 18*a*, 18*b* is near foot 21 which is adjacent groove 22. Knife 18*a*, 18*b* is secured in place by gib 24. Knife 18*a*, 18*b* is comprised of cutting edge 25, back relief 27, knife back 29 and knife face 26. Knife face 26 is in contact with cutter head 10 by engagement of corrugations 30*a* (FIG. 3) on knife face 26 with corrugations 30*b* (FIG. 3) on cutter head 10.

Groove 22 is a truncated "V" shape having the bottom portion of the V cut off. The "V" shape of void 22 allows gib 24 to force knife 18*a*, 18*b* at its knife face 26 or leading edge, against cutter head 10. The trailing side of gib 24 is forced against the trailing edge 20 of groove 22. This compression of gib 24 in groove 22 provides securing pressure against knife 18*a*, 18*b*. In this manner, knife 18*a*, 18*b* is forced against cutter head 10 through the action of gib 24 being forced into groove 22 by securing bolt 28 and the position of knife 18*a*, 18*b* with respect to head 10 is reproducibly established by first positioning of knife base 19 against foot 21 and then lifting the knife upwardly until the interconnection between corrugations 30*a* and 30*b* on knife 18*a*, 18*b* and cutter head 10 is engaged.

Figure 3:
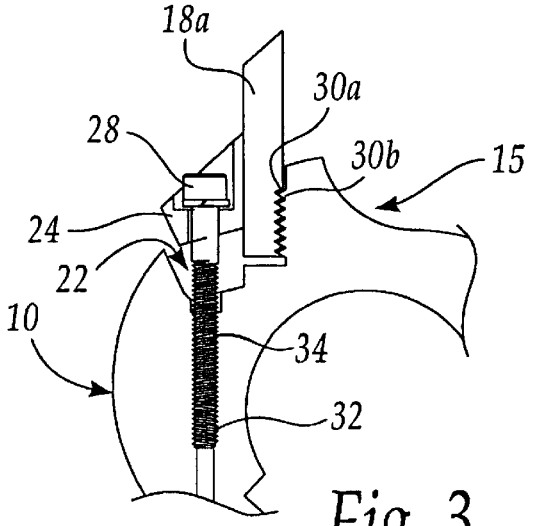
FIG. 3 is a fragmentary cross sectional view of the rotary cutter head shown in FIG. 1 also taken along line 2—2 of FIG. 1, and showing the partial release of the gib from capture of the knife blade by the cutter head and the gib.

Referring now to FIG. 3 in comparison to FIG. 2 it is shown that the novel gib of the present invention can be substantially released from secure contact with cutter head 10 without permitting knife 18*a*, 18*b* to be lost from contact or positioning within cutter head 10. In FIG. 3 bolt 28 has been loosened and raised upwardly. However, due to the increased length of bolt 28 which is permitted by the additional cutter head 10 mass derived from the outward shifting of cutter head mass, gib 24 travels upwardly and maintains contact against knife 18*a*, 18*b* and serves to retain corrugations 30*a* of knife 18*a*, 18*b* in contact with corrugations 30*b* of cutter head 10. This feature provides additional safety for the user of cutter head 10 as gib 24 can become loose without knife 18*a*, 18*b* coming out of cutter head 10.

The configuration of bolt 28, gib 24 and groove 22 with respect to the insertion position of knife 18*a*, 18*b* presents another beneficial feature of the present invention. In much of the prior art to insert or remove a knife blade, it is necessary to first move the cutter head into a first position to loosen a securing means such as a bolt or wedge, and to then move the cutter head into a second position to remove the knife blade from the cutter head. This can result in multiple problems such as allowing the unsecured knife blade to fall from the cutter head onto the floor or into the machine and to become chipped or damaged during removal or insertion, or the loss of the precise positioning of the knife blade within the cutter head prior to tightening and as the cutter head is rotated into a position where the securing mechanism is again accessible for tightening the knife blade within the cutter head. The present cutter head design eliminates these problems by orienting the securing means of the knife 18*a*, 18*b* into the same plane of attack with the insertion of knife 18*a*, 18*b* into cutter head 10. It will be appreciated from an examination of FIG. 2 that an operator would have access to both the head of bolt 28 and knife 18*a*, 18*b* from a single position. From this position, bolt 28 and gib 24 can be tightened or loosened while knife 18*a*, 18*b* is within the grasp of the operator. In this manner, knife 18*a*, 18*b* can be held securely during insertion and removal operations and the position of knife 18*a*, 18*b* can be maintained while the securing means is tightened against knife 18*a*, 18*b*.

Referring now to FIG. 3, the means of removal of knife 18*a*, 18*b* will be discussed. When it is desired to remove the knife blade 18*a*, 18*b* from its position within cutter head 10, the operator positions knife 18*a*, 18*b* within view and bolt 28 within access. Bolt 28 is loosened by retracting bolt threads 34 from cutter head threads 32 to allow gib 24 to be removed. Removal of gib 24 allows the wedging pressure created by gib 24 against knife blade 18*a*, 18*b* to be relieved and sufficient space to be created to remove knife 18*a*, 18*b* from cutter head 10.

In addition to knife 18*a*, 18*b* being secured by the pressure by gib 24, knife 18*a*, 18*b* is also positively secured against cutter head 10 by registrable holding grooves or corrugations 30*a* on knife 18*a*, 18*b* and corresponding corrugations 30*b* on cutter head 10. Corrugations 30*a* and 30*b* serve two purposes, to secure knife 18*a*, 18*b* and to position knife 18*a*, 18*b* within head 10. The securing of knife 18*a*, 18*b* within cutter head 10 is assisted by corrugations 30*a*, 30*b* by their resistance to the outward pressure of centrifugal force placed on knife 18*a*, 18*b*. The registration of corrugations 30*a* within corrugations 30*b* permits the reproducible, positive placement of a set of matched knives 18*a*, 18*b* within cutter head 10. This interaction of corrugations 30*a* within corrugations 30*b* is assisted by foot 21 of cutter head 10. Foot 21 acts as a reference stop for knife base 19 and allows a user to slightly, upwardly withdraw knife 18*a*, 18*b* to achieve, quickly and easily, the exact registration of corrugations 30*a* within corrugations 30*b* for exact and reproducible positioning of cutting edge 25 (FIG. 2) from longitudinal center line C (FIG. 1) of both knives 18*a*, 18*b*. It will be appreciated that due to the flat surfaces above and below corrugations 30*a* and corrugations 30*b* on knife 18*a*, 18*b* and cutter head 10 that if corrugations 30*a* and corrugations 30*b* were not properly matched one of corrugations 30*a* or corrugations 30*b* would be projecting against a flat surface and knife 18*a*, 18*b* would not lie flat against cutter head 10.

It is of particular importance to appreciate the particular alignment and orientation of the combination of elements which act together in the present invention to achieve the inventive result. The corrugations are placed on cutter head 10 itself and not on an additional element which can slip or require further adjustment. The knife corrugations are placed on cutting face 26 of knife 18*a*, 18*b*, but are limited to the bottom segment of knife 18*a*, 18*b* which is disposed in cutter head 10. If corrugations 30*a* of knife 18*a*, 18*b* extended upwardly on cutting face 26 of knife 18*a*, 18*b* they would interfere with sharpening of the knife. Many prior art knives include corrugations on the entirety of knife back 29. This does not present a problem as when the knife is sharpened the corrugations are on back relief 27 and do not interfere with cutting edge 25. However, if the corrugations are extended up cutting face 26 they will interfere with the sharpening of knife 18*a*, 18*b* as a straight edge will not be presented. It is for this reason that prior art knives have not heretofore recognized the use of the cutting face for corrugations 30*a*.

Thus, the unique shaping of cutter head 10 allows for the removal of mass from in front of the leading edge of knife 18*a*, 18*b* to provide additional space for the elimination of waste 17. The unique shaping of cutter head 10 also provides substantial area in back and beneath knife 18*a*, 18*b* to permit gib 24 to be inserted behind knife 18*a*, 18*b* and compress the knife into the corrugations while avoiding workpiece waste 17 clogging access to gib securing means or bolt 28.

It will be appreciated that during sharpening of knives 18*a*, 18*b* grooves 30*a* may be positioned similarly in a sharpening device thus allowing the cutting edges of knives 18*a*, 18*b* to be sharpened to the same height. In this manner, knife sets of uniform weight and length may be generated which then allow exact and convenient insertion and alignment of the knife sets within cutter head 10 in order to reduce the amount of maintenance and downtime being devoted to the shaping apparatus in which cutter head 10 is being operated.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details show or described.

Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense.

Having now described the features, discoveries and principles of the invention, the manner in which the improved rotary cutter head is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

Having thus described the invention what is claimed as new and desired to be secured by Letters Patent is as follows:

1. A holder for rotating a cutting knife, said holder comprising:

a cutter head having, generally, a shape of outwardly-shifted cylinder segments to provide a cutter head having reduced cutter head mass in front of the knife and increased cutter head mass at the base of the knife, said cutter head being rotatable about a longitudinal axis, a void in each of said cutter head outwardly-shifted cylinder segments for insertion of the knife therein, and means for securing the knife in said void to allow cutting and shaping of a workpiece as said cutter head is rotated.

2. The apparatus as claimed in claim 1 further comprising a knife-contacting sidewall in said void said sidewall having a plurality of corrugations thereon said corrugations being mateable with corrugations on a cutting-face of the knife for positive knife contact and knife position registration with said sidewall.

3. The apparatus as claimed in claim 1 further comprising a generally V-shaped gib mountable in said void to secure the knife against said sidewall.

4. The apparatus as claimed in claim 2 further comprising a foot in said void, said foot cooperating with said corrugations to provide reproducible engagement between said knife corrugations and said sidewall corrugations for reproducible knife positioning in said cutter head.

5. The apparatus as claimed in claim 3 wherein said gib is secured in said void by a bolt engaged with threaded, bolt-receiving voids in said cutter head.

6. A holder for rotating a cutting knife, said holder comprising:

a cutter head having, generally, a shape of bi-laterally offset, cylinder halves to provide a cutter head having reduced cutter head mass in front of the knife and increased cutter head mass at the base of the knife, said cutter head being rotatable about a longitudinal axis, a void in at least one of said bi-laterally offset cylinder halves for insertion of the knife therein, and means for securing the knife in said void to allow cutting and shaping of a workpiece as said cutter head is rotated.

7. The apparatus as claimed in claim 6 further comprising a knife-contacting sidewall in said void said sidewall having a plurality of corrugations thereon said corrugations being mateable with corrugations on a cutting-face of the knife for positive knife contact and knife position registration with said sidewall.

8. The apparatus as claimed in claim 6 further comprising a generally V-shaped gib mountable in said void to secure the knife against said sidewall.

9. The apparatus as claimed in claim 7 further comprising a foot in said void, said foot cooperating with said corrugations to provide reproducible engagement between said knife corrugations and said sidewall corrugations for reproducible knife positioning in said cutter head.

10. The apparatus as claimed in claim 8 wherein said gib is secured in said void by a bolt connected in threaded bolt-receiving voids in said cutter head.

11. A holder for rotating a knife, said holder comprising:

a cutter head having, generally, a shape of bi-laterally offset, cylinder halves to provide a cutter head having reduced cutter head mass in front of the knife and increased cutter head mass at the base of the knife, said cutter head being rotatable about a longitudinal axis, a void in each of said bi-laterally offset cylinder halves for receiving the knife therein, a knife-contacting sidewall in said void said sidewall having a plurality of grooves therein said grooves being mateable with a plurality of grooves on the cutting blade for positive blade contact and blade height registration of said blade with said sidewall, a generally V-shaped gib mountable in said void to secure said blade against said sidewall, and means for securing said gib in said void to allow cutting and shaping of a workpiece as said cutter head is rotated.

12. The apparatus as claimed in claim 11 wherein said gib is secured in said void by a bolt connected in threaded bolt-receiving voids in said cutter head.

13. A holder for rotating a knife comprising:

a cutter head rotatable about a longitudinal axis, said cutter head being shaped, generally, as a tri-sected cylinder where each of said cylinder tri-sections is outwardly-shifted from a center-line of said cylinder to provide a cutter head shape having three sections, each of said sections having said knife-holding void therein, to provide a three knife cutter head having reduced cutter head mass in front of each knife and increased cutter head mass at the base of the knife, a void in said cutter head for holding the knife therein, said void presenting a knife-contacting sidewall having a plurality of corrugations thereon for mateable engagement with a plurality of corrugations on a cutting face of the knife, a foot in said void, said foot cooperating with said corrugations to provide reproducible knife corrugation registration with said sidewall corrugations of said cutter head, a generally V-shaped gib mountable in said void to secure said knife against said sidewall, and means for securing said gib in said void to retain said gib and said knife in contact with said cutter head to allow cutting and shaping of a workpiece as said cutter head is rotated about said longitudinal axis.

14. The apparatus as claimed in claim 13 wherein said gib is secured in said void by a bolt connected in threaded bolt-receiving voids in said cutter head.

15. A holder for rotating a knife comprising:

a cutter head rotatable about a longitudinal axis, said cutter head being shaped, generally, as a bi-sected cylinder where each of said cylinder bi-sections is outwardly-shifted from a center-line of said cylinder to provide a cutter head shape having two sections, each of said sections having said knife-holding void therein, to provide a two knife cutter head having reduced cutter head mass in front of each of said knives and increased cutter head mass at the base of each of said knives, a void in said cutter head for holding the knife therein, said void presenting a knife-contacting sidewall having a plurality of corrugations thereon for mateable engagement with a plurality of corrugations on a cutting face of the knife, a foot in said void, said foot cooperating with said corrugations to provide reproducible knife corrugation registration with said sidewall corrugations of said cutter head, a generally V-shaped gib mountable in said void to secure said knife against said sidewall, and means for securing said gib in said void to retain said gib and said knife in contact with said cutter head to allow cutting and shaping of a workpiece as said cutter head is rotated about said longitudinal axis.

16. The apparatus as claimed in claim 15 wherein said gib is secured in said void by a bolt connected in threaded bolt-receiving voids in said cutter head.

* * * * *